United States Patent [19]

Hills et al.

[11] Patent Number: 4,752,304

[45] Date of Patent: Jun. 21, 1988

[54] BLADE STROPPING APPARATUS

[75] Inventors: Ivan E. Hills, Kinnelon; George A. Holmelund, Dover, both of N.J.

[73] Assignee: Hacker Instruments, Inc., Fairfield, N.J.

[21] Appl. No.: 911,165

[22] Filed: Sep. 24, 1986

[51] Int. Cl.[4] ..... B24B 3/36

[52] U.S. Cl. ..... 51/84 BS; 76/81.7

[58] Field of Search ..... 51/40, 41, 80 A, 80 BS, 51/80 B, 82 BS, 82 R, 84 BS, 84 R, 85 BS, 86 R, 81 BS, 81 R, 92 BS, 92 ND, 108 BS, 91 BS, 85 R, 86 BS; 76/81.7, 81

[56] References Cited

U.S. PATENT DOCUMENTS 1,082,904 12/1913 Persault et al. ..... 51/86 BS 4,092,805 6/1978 Williams ..... 76/81.7

*Primary Examiner*—Roscoe V. Parker

*Attorney, Agent, or Firm*—Bernard J. Murphy

[57] ABSTRACT

In the embodiment depicted, the apparatus has a pair of contra-rotating stropping wheels to, and between which successive blades are carried for stropping. A blade-carrier magazine is supported on a rack for slidable translation thereof below a transversingly-travelling blade clamp. A solenoid operates the clamp to cause it to sieze a blade from the therebelow magazine and carry it to the stropping wheels while holding the blade fast. After a blade has been adequately stropped, the clamp returns it to the magazine, to its individual carrier, and displaces a limit stop to allow the magazine to advance and present a next blade to the clamp. The clamp is threadedly engaged with a drive screw, whereby the clamp is moved back and forth between the wheels. Corresponding fore and aft drive clutches, driven by a dual-speed motor, rotate the drive screw, alternatingly, in clockwise and counter-clockwise rotations. A counter operatively engaged with one of the clutches serves to signal when the motor driving the wheels should alter its rotary speed.

15 Claims, 5 Drawing Sheets

FIG. 9
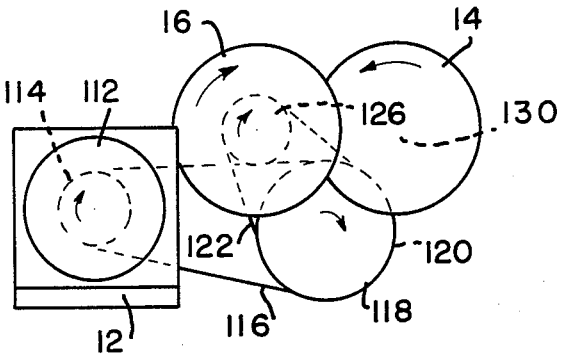
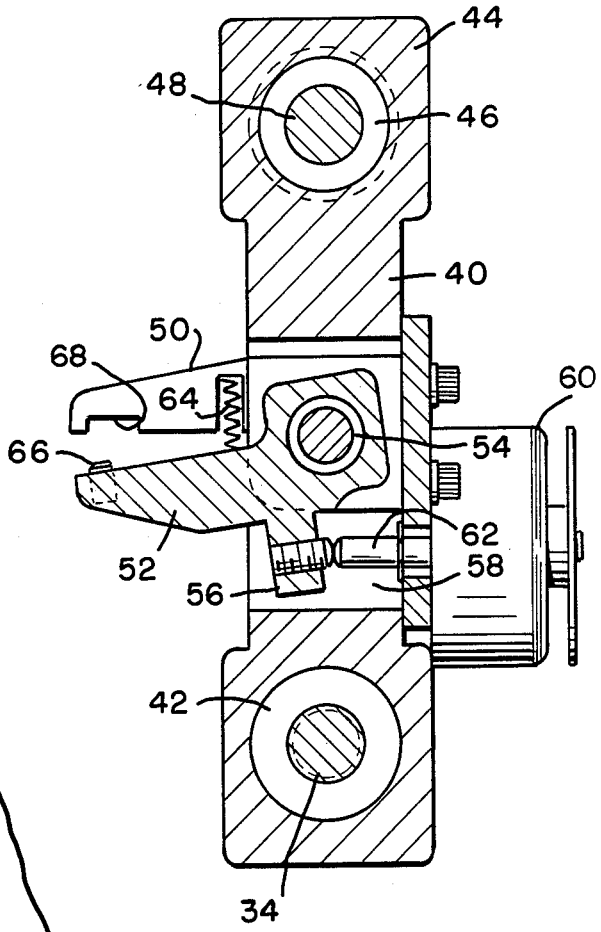
FIG. 5
FIG. 7
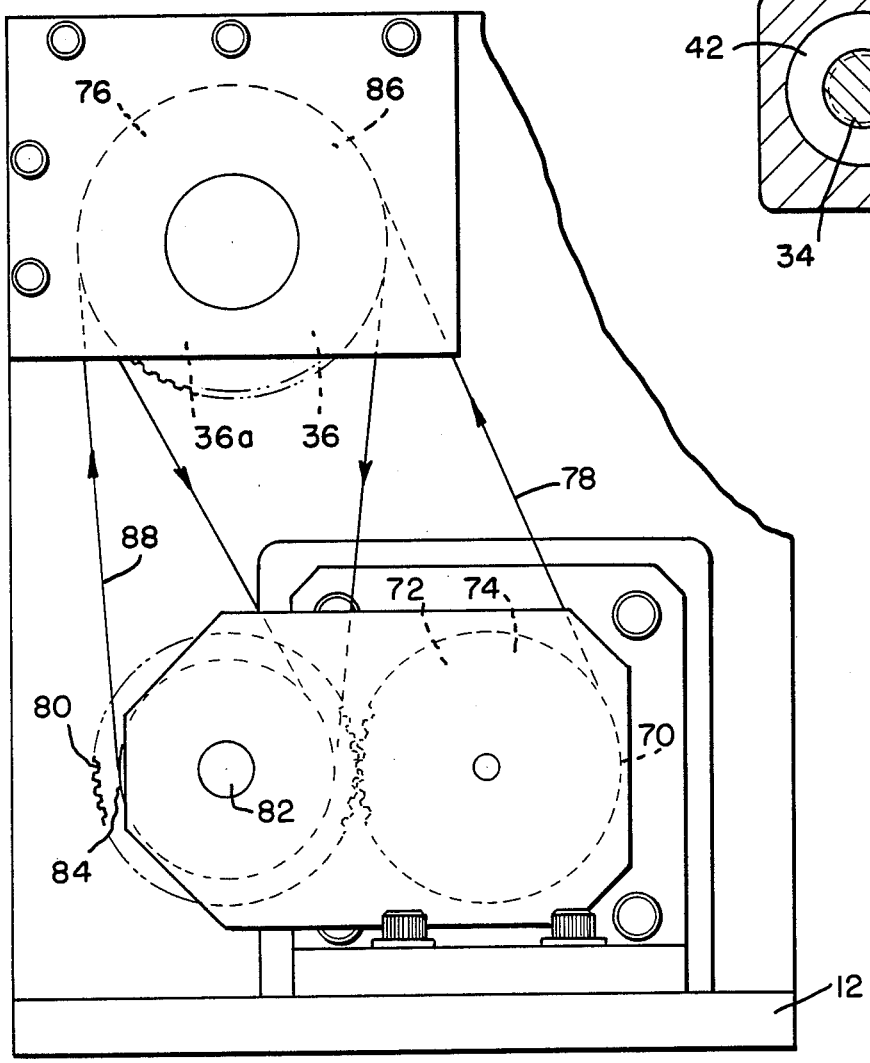

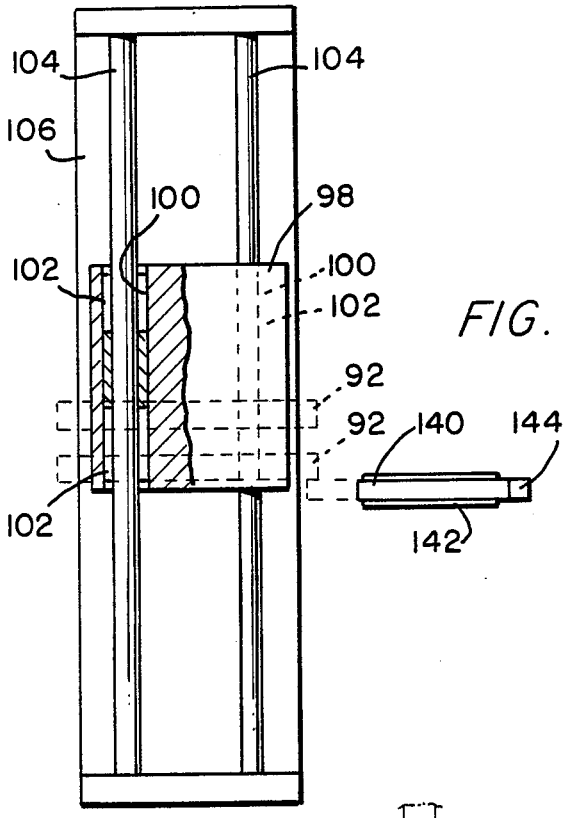
FIG. 8
FIG. 10
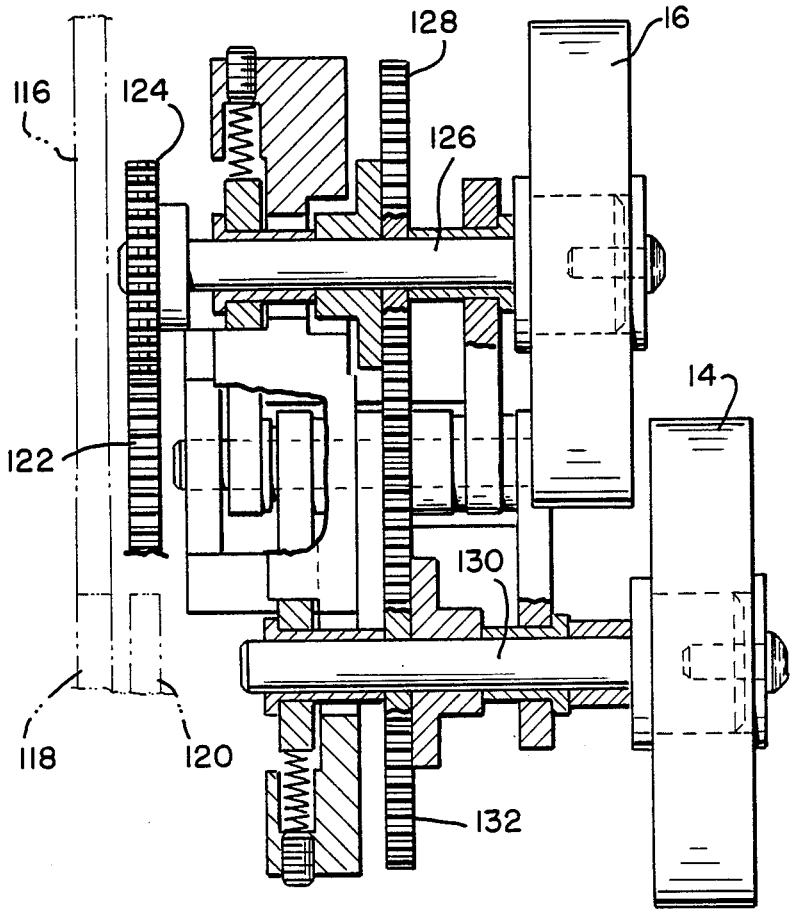

BLADE STROPPING APPARATUS

This invention pertains to blade stropping apparatus, and in particular to such apparatus especially defined for the stropping of microtome blades.

Apparatus of the aforesaid type is generally well known in the prior art. However, typically such apparatus requires the sequential and manual ministration to each successive blade. The known apparatus requires that one blade at a time be manually secured in a holder, and translated across the stropping wheels.

What has long been sought is an automatic blade stropping apparatus in which a plurality of blades can be charged into a magazine, the magazine fed to a selective blade clamp and carrier, and each blade, in turn, be extracted from the magazine, carried to the stropping wheels, returned to the magazine, and the magazine advancing a next, then a next, etc., blade for engagement by the clamp and carrier, stropping, and return to the magazine.

It is an object of this invention, then, to set forth just such a long sought, automatic blade stropping apparatus.

Particularly, it is an object of this invention to disclose a novel blade stropping apparatus, comprising an elongated platform; stropping wheels supported on said platform adjacent to one end thereof; carriage means, supported by said platform, motor-operative for transporting blades toward said one end of said platform for stropping thereof by said wheels, and away from said one end, following stropping thereof by said wheels; said carriage means having means for (a) clamping blades and holding them fast, and (b) carrying such clamped and held blades between said wheels; motor means coupled to said wheels and said carriage means for (a) rotating said wheels, and (b) operating said carriage means; a blade magazine for carrying a plurality of blades; and a rack supported by said platform; wherein said magazine and said rack have means cooperative for accommodating said magazine on said rack (a) for translation of said magazine therealong, and (b) for supplying blade to said clamping and carrying means.

Further objects of the invention, as well as the novel features thereof, will beocme more apparent by reference to the following description, taken in conjunction with the accompanying figures, in which:

FIG. 5 is a cross-sectional view taken along section 5—5 of FIG. 4;

FIG. 7 is an end elevational view of the clutch drive arrangement;

FIG. 8 is a plan view of the slide carriage for the blade magazine;

FIG. 9 is a side elevational view of the stropping wheels drive arrangement;

FIG. 10 is a plan view, partly in cross-section, of the stropping wheels drive arrangement.

Figures 1, 2:
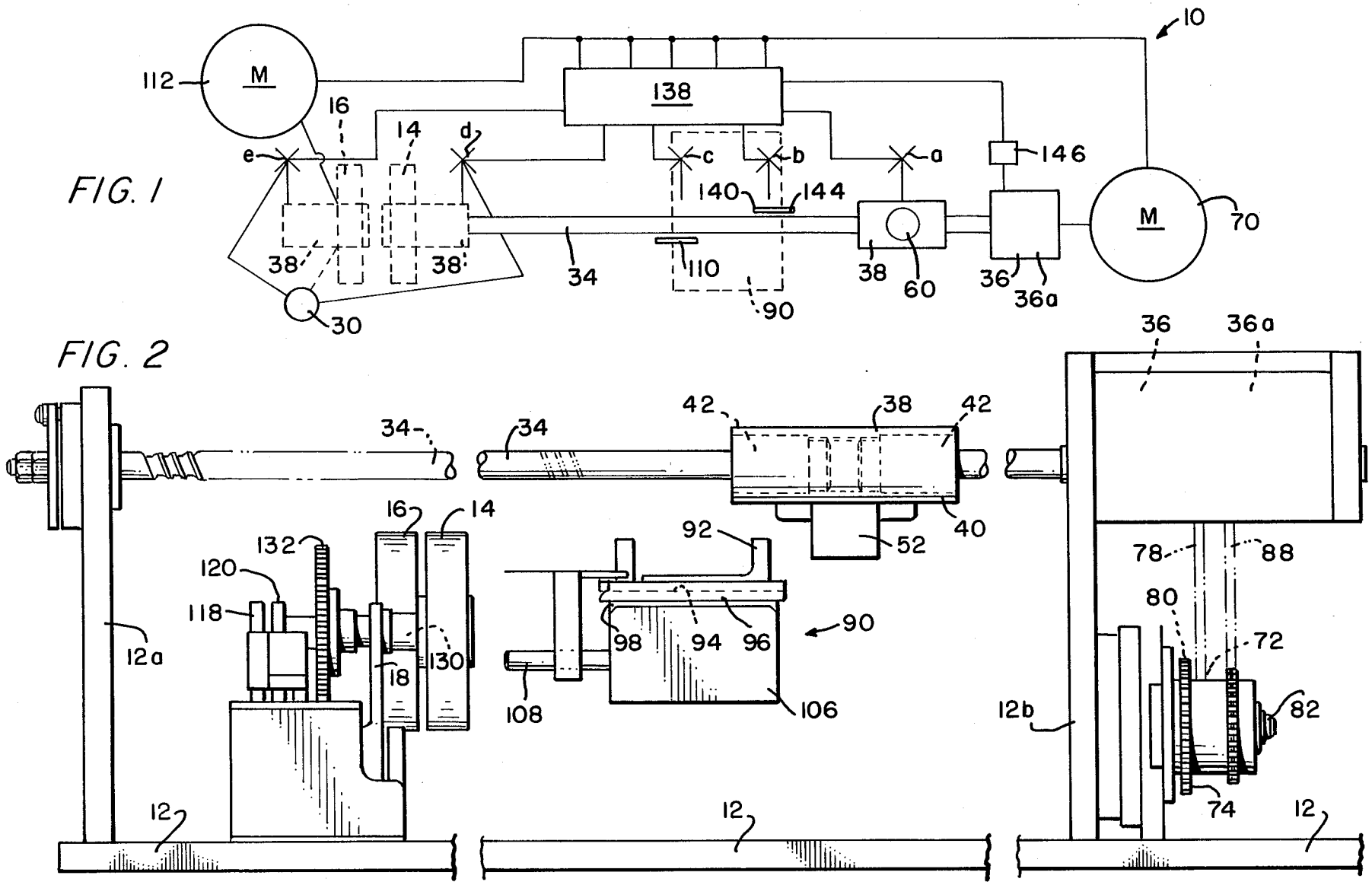
FIG. 1 is a line schematic of the novel blade stropping apparatus, according to an embodiment thereof.
FIG. 2 is a side elevational view thereof.
Figure 3:
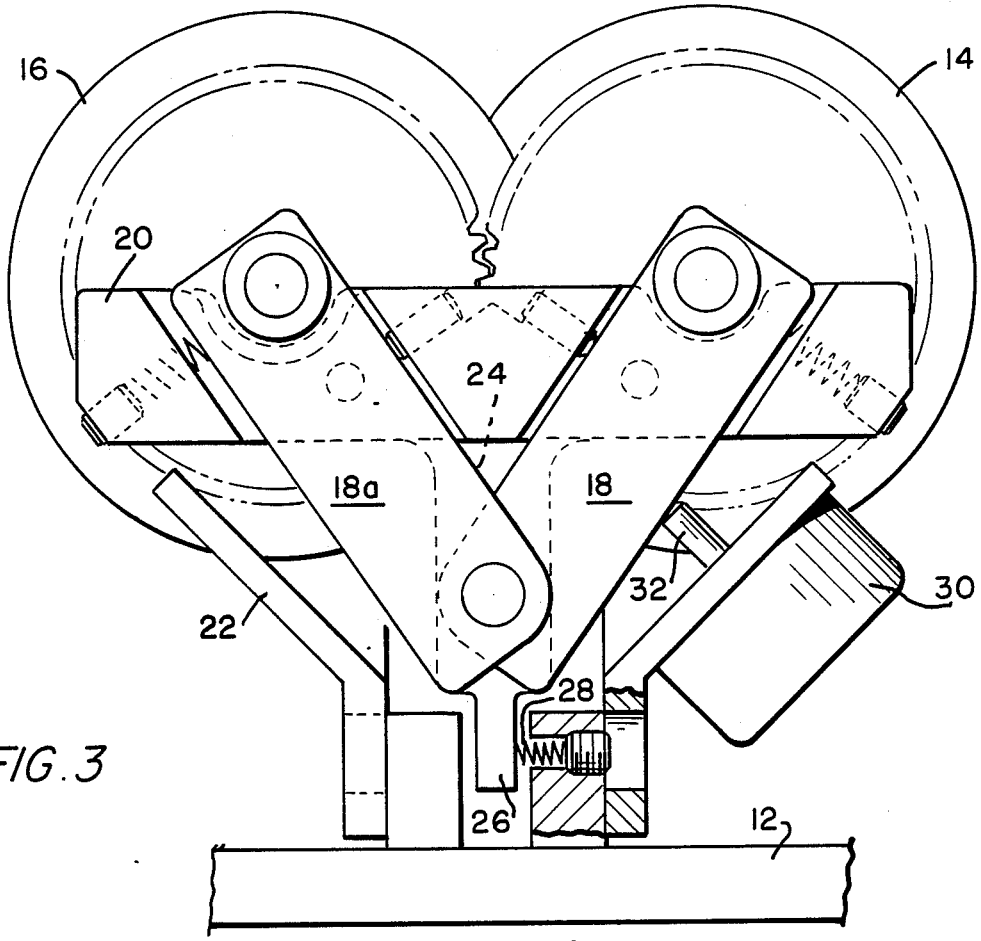
FIG. 3 is an end, elevational view of the pivot-mount of the stropping wheels.
Figure 4:
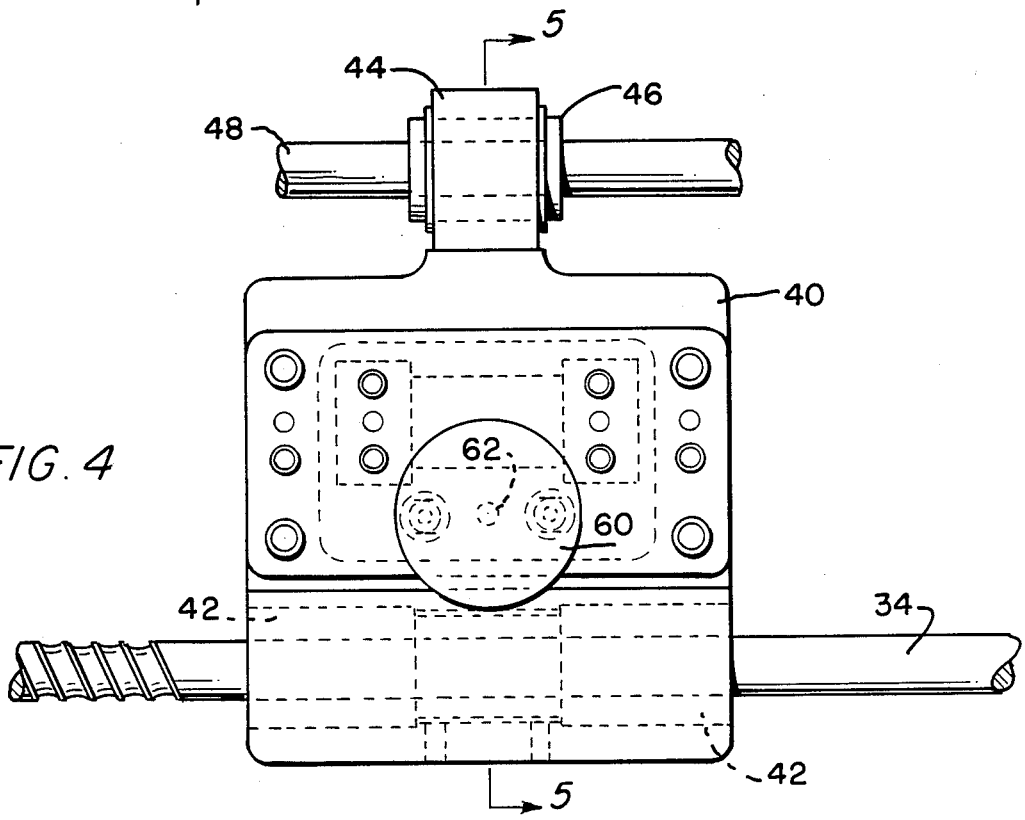
FIG. 4 is a plan view of the solenoid-operated blade clamp and carrier.

As shown in the figures, the novel blade stropping apparatus 10, comprises a platform 12 upon which a pair of stropping wheels 14 and 16 are rotatably journalled. The wheels 14 and 16 are rotatably carried on shafts fixed in ends of limbs 18 and 18*a* which, in turn, are secured to a cross member 20. The latter is coupled to a yoke 22 which is secured to the platform 12. The cross member 20 has a perpendicular leg 24 to which the opposite ends of the limbs 18 and 18*a* are pivoted. A short stub 26 extends from the leg 24 and it is engaged by a spring 28 compressed between the stub 26 and a portion of the yoke 22. A solenoid 30 having an extending plunger 32 is operatively engaged with one of the limbs—limb 18. When the solenoid 30 is inactive (quiescent), the spring 28 biases the wheels 14 and 16 in a clockwise inclination or tilt. Activation of the solenoid 30 causes the plunger 32 to extend and incline or tilt the wheels 14 and 16 in the alternative direction, against the bias of the spring 28. It is in this way that one of the wheels—i.e., wheels 14—strops the front of a blade interposed between the wheels, while the blade is translated therebetween in a first direction, and wheel 16 strops the rear of the interpositioned blade when the latter translates in the opposite, second direction.

A motor-driven screw 34 is supported in elevation along the length of the platform 12. It is journalled in an upright 12*a*, at one end of the platform, and in a clutch-mounting plate 12*b* at the other end. A pair of electric clutches 36 and 36*a* are drivingly coupled to the screw 34 through the mounting plate 12*b*.

A carriage 38 has a body 40 which has nuts 42 confined therein for threaded engagement with the screw 34. Additionally, body 40 has an appendage 44 in which is carried a ball bushing 46. The latter slidably receives a guide rod 48 which, in parallel with the screw 34, is fixed at opposite ends thereof in upright 12*a* and plate 12*b*.

Pendant from the body 40 are jaws 50 and 52. Jaw 50 is fixed immovably to the body 40, whereas jaw 52 is pivotably pinned on a rod 54 which is supported in the body 40 and penetrates an inner end of jaw 52. Jaw 52 has an outwardly-extending arm 56. The arm 56 projects into a void 58 provided therefor within the body 40. Mounted thereabove is a solenoid 60 which has a projecting plunger 62. Plunger 62 is poised for operative displacement of the arms 56. Accordingly, with solenoid-actuated pivoting of jaw 52, it closes onto jaw 50, against the bias of a spring 64 which is nested in jaw 50 and has an end contacting and urging jaw 50 away therefrom. The closing face of jaw 52 has a pair of pins 66 extending therefrom, and the matching face of jaw 50 is recessed at 68 to receive the pins 66 therein.

A dual-speed motor 70 is mounted to the platform 12, and by means of sprockets, drive belts and gears, drives the clutches 36 and 36*a*. The motor 70 directly drives a sprocket 72 and a gear 47. Clutch 36 has a sprocket 76 engaged therewith, and a drive chain 78 drivingly couples sprocket 72 and sprocket 76 whereby to power clutch 36. An idler gear 80 journalled on a stub shaft 82 has a sprocket 84 joined thereto. Too, clutch 36*a* has a sprocket 86 engaged therewith. A drive chain 88 drivingly coupled sprockets 84 and 86, and gears 74 and 80 are in mesh. In this way clutch 36*a* is powered.

The blade holder magazine 90 is the subject of its own co-pending patent application, Ser. No. 890,647, filed July 30, 1986 (now U.S. Pat. No. 4,685,564). Its co-inventorship is the same as in the instant application, and is commonly assigned to the same assignee. For a fuller explanation of the novel functioning of the blade holder magazine 90, the aforesaid co-pending patent application is incorporated herein by reference. It should suffice here to note that the magazine has ten blade carriers 92 (only one thereof being shown in FIG. 2). They are disposed in parallel (spaced apart, behind the one shown in FIG. 2), and are slidably engaged with slots 94 provided therefor in a magazine platform 96. The platform 96 has a slide carriage 98 thereunder, and the carriage 98 has channels 100 therethrough in which are confined four ball bushings 102. The latter slidably receive a pair of rods 104 which are fixed, at opposite ends thereof, in a rack 106. The rack 106 is fixed to the apparatus platform 12, and it lies transverse to the screw 34 and guide rod 48.

A support 108 is fixed in the rack 106, and to one side thereof, and presents a limit stop arm 110 before a foremost one of the blade carriers (i.e., carrier 92). A spring (not shown) is engaged with a forward portion of the rack 106 and the thereadjacent, leading end of the slide carriage 98. Thus, the latter is normally urged forwardly. As noted, however, arm 110 is sited to prohibit the spring-urged travel of the carriage 98 as an end of the arm 110 blocks forward movement of the foremost blade carrier 92. Arm 110 is a significant element of a novel feed mechanism, of the apparatus 10, which selectively feeds successive ones of the carriers 92 to the jaws 50 and 52, in turn. Of this, more is explained in the ensuing text.

FIG. 9 shows the general relationship between the stropping wheels 14 and 16, and the dual-speed drive motor 112 therefor, and FIG. 10 depicts the motor-to-wheels power train. The motor 112 turns a sprocket 114 which, through a chain 116, drives a larger sprosket 118. The latter has another sprocket 120 coupled thereto in juxtaposition which, through another chain 122, drives a smaller sprocket 124. Sprocket 124 drives a first wheel shaft 126 to which is drivingly mounted wheel 16 and a gear 128. A second wheel shaft 130 drivingly mounts wheel 14 and a gear 132; the latter is in mesh with gear 128, whereby drive is imparted to shaft 130.

Figure 11:
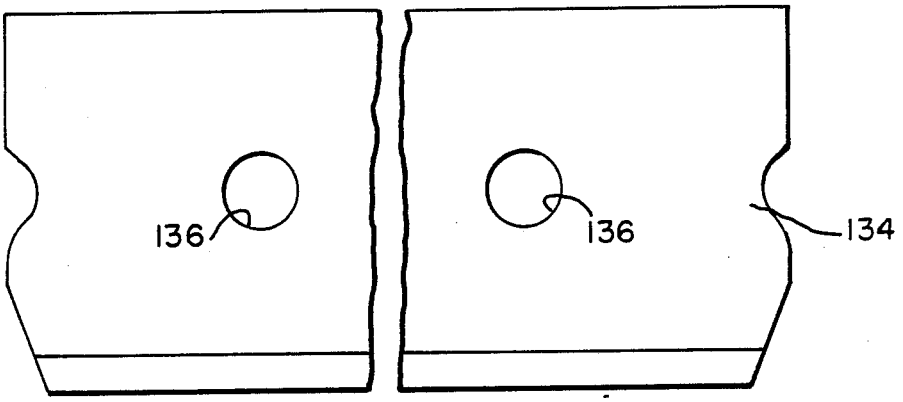
FIG. 11 is a side elevational view of the novel, holed microtome mini-knife especially configured for stropping by the instant, inventive stropping apparatus.
Figure 6:
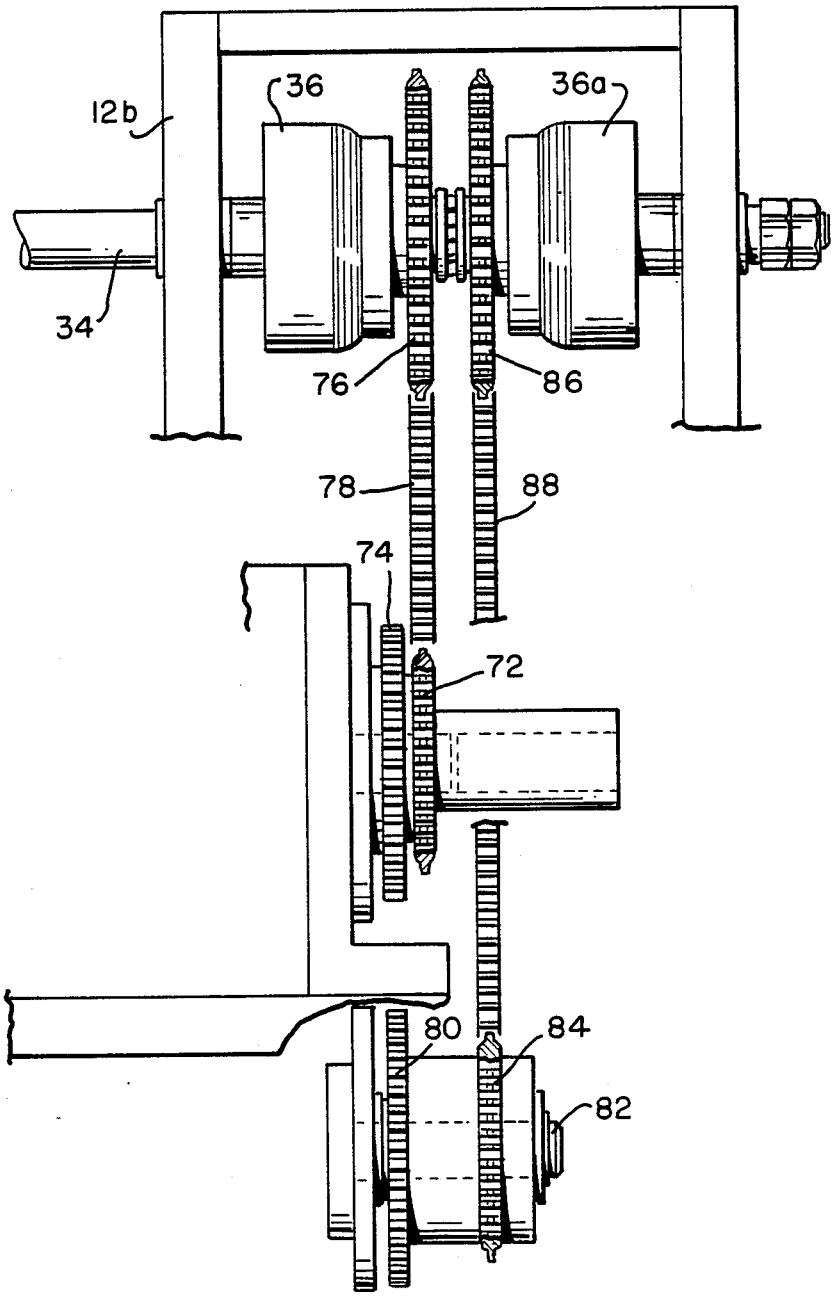
FIG. 6 is a view of the two-clutch drive arrangement generally in an elevational presentation; the idler gear is shown below the driven gear (instead of behind as it is in actuality) only for clarity of depiction.

The raison d'etre for all the aforedescribed structures, a novel, dual-holed, microtome mini-knife (or blade) 134 is shown in FIG. 11. The knife or blade 134 has the two holes 136 for receiving therein the pins 66 which extend from the jaw 52. Pins 66 protrude through the holes 136 and enter recessed jaw 50, securely to hold the blade 134 fast in the carriage 38 all the while that the blade is stropped by the wheels 14 and 16.

Control circuitry and monitoring devices, which operate the apparatus, are principally confined within a control box 138. The latter contains proprietary electronics, but is available from Hacker Instruments, Inc., of Box 657, Fairfield, N.J. 07007-0657. The functioning of the control box 138, in cooperation with platform mounted switches "a" through "e" (FIG. 1), to operate the apparatus will be explored in the following text.

Earlier it was explained how arm 110 of a feed mechanism functions to limit travel of the carriage 98. Now, there's another limit stop arm 140 which, unlike arm 110, is displaceable. Arm 140 is mounted upon a stanchion 142 which rises from the apparatus platform 12. It is straight throughout its length, except for a dog-leg stub 144 which is turned up therefrom. A spring (not shown) biases the limit stop arm 140 normally to the dashed-line position thereof shown in FIG. 8. In this position, the arm intrudes between a foremost blade carrier 92, and a carrier 92 immediately therebehind. Carriage 38, in its travel along screw 34, passes directly over the foremost blade carrier 92, in order that the blade 134 set therein will be clamped by the jaws 50 and 52 and carried to the wheels 14 and 16. When the carriage 38 returns the stropped blade 134 to the magazine 90 (from whence it was taken), it operates the feed mechanism. An undersurface of the carriage body 40 engages the dog-leg stub 144 and forces the arm 140 to the right (as shown in the full-line illustration in FIG. 8). This is so, as the jaws 50 and 52 do not release the blade, after stropping thereof, in the same position in the magazine as it had when it was taken therefrom. Rather, the jaws carry the blade 134, and hence its carrier 92 further to the right on the magazine 90. The carriage body 40 proceeds to a "park" position where, as just noted, it delays the release of the blade in the process, and forces the arm 140 out of the way of a next carrier 92 (which it had been obstructing). The delayed release of the just-stropped blade, and its offset position (to the right, as shown in FIG. 2) in its carrier 92, permits said carrier to avoid the arm 110. As a result, the next carrier 92 can proceed to the arm 110 where it awaits the jaws 50 and 52. Again, as the carriage 38 proceeds along the screw 34, to clasp the waiting blade in the just-advanced carrier, the undersurface of the body 40 releases the stub 144 to allow the arm 140 to reposition itself before a next carrier 92 in the magazine 90.

Counter 146 is operatively coupled to one of the clutches (in this embodiment: clutch 36) to monitor the number of times it rotates and, in cooperation with the control box 138, supervises the operation of the apparatus.

In operation, carriage 38 moves from its "park" position (as shown in FIG. 2), in response to the rotation of the screw 34, to a position directly above a foremost blade carrier 92. There, the carriage 38 stops, and jaw 52 closes to seize a blade 134 held in the carrier 92. In this, the carriage 38 has bypassed switch "b" (FIG. 1), without the latter effecting any operation, and proceeded to switch "c". It is here, through the switch sensor in cooperation with the control box 138, that the jaw 52 clamps the blade. Next, the carriage 38, with the blade 134 securely held therein, proceeds to the wheels 14 and 16. When the carriage comes abreast of switch "d" the blade 134 enters in front of the wheel 14. While motor 112 is roating the wheels 14 and 16, the blade enters the area, initially, without contacting wheel 14. Promptly thereafter, however, as the carriage proceeds to carry the blade 134 toward switch "e", the solenoid 30 activates to tilt the assembly and force the wheel 14 to engage, and strop, the blade.

As the carriage 38 encounters the switch "e", and its carriage sensor, the solenoid 30 is deactivated, and the screw 34 rotates in its alternative direction. Whereas one clutch 36 operated to drive the screw 34 in one direction, to move the carriage 38 away from its "park position", the other clutch **36*a* operates to drive the screw alternatively. Too, the spring 28 forces the wheel 16** into blade-stropping engagement at this time.

According to a predetermined program, the blades are stropped, perhaps ten to twenty times, by the wheels 14 and 16, at a high speed, and then ten to twenty times at a slow speed. Switches "d" and "e", with their carriage sensors, cause the carriage 38 to cycle, repeatedly, back and forth, between the wheels for the number of stropping passes at the high speed, and then counter 146 causes the motor 122 to reduce its speed to the prescribed slow speed for the cycles of slow speed stropping. The counter 146 monitors the number of times that the clutch 36 rotated, in fast speed, and signals the control box 138 to decelerate the motor. Again, the counter 146 monitors the number of cycles of operation of clutch 36 in the slow speed mode, and signals the control box to have the screw 34 turn to withdraw the carriage 38 from the stropping wheels area.

On returning to the right-hand portion of the apparatus 10, the carriage 38 bypasses switch "c" without effect, and encounters switch "b" and its carriage sensor. All the while, the jaws 50 and 52 retained clamped possession of the blade 134. For having carried the blade thus far, the blade carrier 92 is caused to slide to the right where, as earlier explained, it avoids the limit stop arm 110. Too, also as earlier explained, the carriage body 40 engage the dog-leg stub 144 and withdraws the other limit stop arm 140 from interference with the advance of a next blade carrier 92. Astride switch "b", the jaws 50 and 52 release the blade 134.

Control box 138 incorporates circuitry which institutes a delay in a re-cycling of the operations. Therefore, the carriage 38 remains in the "park" position which it assumes after returning the stopped blade, and releasing it to its—now, laterally offset carrier 92—for the prescribed time delay.

The magazine 90, at least in this embodiment of the invention, carries ten blades 134. Consequently, the number of fast speed and slow speed cycles which the clutch 36 shall manifest calls for the multiplier ten, before the full complement of blades are stropped. The counter 146 continuously monitors the total count of clutch 36 so that, in cooperation with the control box 138, the apparatus will shut down when the last blade has been fully stropped. On the latter having occurred, the counter 146 and control box 138 allow the carriage 38 to travel to switch "a" (FIG. 1) where the motors 70 and 112 are brought to a halt.

When the last blade 134 has been returned to the magazine 90, all the carriers 92 shall be offset so as to avoid the arm 110, and there shall remain no further carrier 92 to be encountered by arm 140. Consequently, the magazine 90 simply advances along the rack 106 to be out from under the screw 34.

Now, while we have described our invention in connection with a specific embodiment thereof, it is to be clearly understood that this is done by way of example, and not as a limitation to the scope of our invention, as set forth in the objects thereof, and in the appended claims. For instance, while a counter 146 is disclosed as having a principal control of the operation of the apparatus 10, it is quite within the ken of those skilled in this technology to employ a timer which will monitor the operations pursuant to known, predetermined time lapses arising in each of the cycles of stropping, blade changing, etc. Also, while switches "a" through "e", having carriage sensors, are shown, the same could be dispensed with by employing a microcontroller to operate the motors 70, 112, the solenoids 60 and 30, etc. All such modifications and alterations of our basic invention are deemed to proceed from our teachings herein, and are considered to be within the ambit of our ensuing claims.

We claim:

1. Blade stropping apparatus, comprising:

an elongated platform;

stropping wheels rotatably supported on said platform adjacent to one end thereof;

carriage means, supported by said platform, motor-operative for transporting blades toward said one end of said platform for stropping thereof by said wheels, and away from said one end, following stropping thereof by said wheels;

said carriage means having means for (a) clamping blades and holding them fast, and (b) carrying such clamped and held blades between said wheels;

motor means coupled to said wheels and said carriage means for (a) rotating said wheels, and (b) operating said carriage means;

a blade magazine for carrying a plurality of blades; and a rack supported by said platform, wherein said magazine and said rack have means cooperative for accommodating said magazine on said rack (a) for translation of said magazine therealong, and (b) for supplying blades to said clamping and carrying means.

2. Blade stropping apparatus, according to claim 1, wherein:

said clamping and carrying means comprises a body;

said body having a pair of confronting and pendent jaws;

at least one of said jaws is pivotably mounted to said body;

means interposed between said jaws urging them apart; and means operatively engaged with said one jaw for forcing said one jaw to pivot toward the other jaw of said pair.

3. Blade stropping apparatus, according to claim 1, wherein:

said clamping and carrying means comprises a body;

said body having a pair of confronting and pendent jaws;

at least one of said jaws is pivotably mounted to said body for pivotable movement thereof, in first and second directions relative to the other of said jaws:

means engaged with said one jaw urging it in one of said first and second directions to cause said one jaw to slue away from the other of said jaws; and means engaged with said one jaw for forcing it in the other of said first and second directions to cause said one jaw to slue toward the other of said jaws for cooperation therewith to clamp and hold a blade therebetween.

4. Blade stropping apparatus, according to claim 3, wherein:

said one jaw has a limb projecting therefrom;

said forcing means comprises solenoid having a translating plunger said solenoid is mounted upon said body; and said plunger is engaged with said limb.

5. Blade stropping apparatus, according to claim 3, wherein:

said carriage means comprises a guide rod; and said body has means slidably engaged with said guide rod.

6. Blade stropping apparatus, according to claim 5, wherein:

said carriage means further comprises a ball screw rotatably journalled said platform;

said body has a ball nut threadedly engaged with said ball screw; and said motor means comprises means drivingly engaged with an end of said screw for effecting rotation thereof and concomitant translation of said ball nut and said body lengthwise of said screw.

7. Blade stropping apparatus, according to claim 6, wherein:

said motor means further comprises a pair of clutches operatively engaged with said end of said screw, and a motor drivingly engaged with both clutches; and one of said clutches comprises means for rotating said screw in a counter-clockwise direction, and the other of said clutches comprises means for rotating said screw in a clockwise direction.

8. Blade stropping apparatus, according to claim 7, wherein:

said clutches are electrically engaged and disengaged;

said platform has a pair of position switches disposed for engagement by said body during translation thereof lengthwise of said screw;

one of said switches comprising means for effecting electrical engagement of one of said clutches, and the other of said switches comprising means for effecting electrical engagement of the other of said clutches.

9. Blade stropping apparatus, according to claim 7, wherein:

said motor comprises means for selectively driving said clutches at a plurality of rotary speeds.

10. Blade stropping apparatus, according to claim 1, wherein:

said magazine comprises means for supporting thereon, and slidably relative thereto, a plurality of juxtapositioned blade carriers;

said magazine including a base;

said base having a channel formed therein;

said rack having a guide rod;

said channel is slidably engaged with said rod; and said rack further has a limit stop disposed to engage blade carriers and prohibit movement of said magazine therebeyond.

11. Blade stropping apparatus, according to claim 1, further including:

escapement means for sequentially disposing progressively advanced portions of said magazine in alignment with said clamping and carrying means, whereby successive blades, upon such being carried by said magazine, in turn, can be clamped and carried to said stropping wheels.

12. Blade stropping apparatus, according to claim 11, wherein:

said escapement means comprises a first limit stop element disposed for obstructively engaging successive ones of such blades as are carried by said magazine, and a second limit stop element disposed for obstructively engaging successive ones of such blades as are immediately adjacent to each of those which are obstructively engaged by said first limit stop.

13. Blade stropping apparatus, according to claim 12, wherein:

said clamping and carrying means comprises means for carrying successive ones of such blades as are carried by said magazine in circumvention of said first limit stop.

14. Blade stropping apparatus, according to claim 13, wherein:

said second limit stop element has a first, normally disposed position, in which it is capable, as aforesaid, for obstructing blades carried by said magazine, and has a second, alternatively-disposed position in which it is incapable of obstructively engaging the aforesaid immediately adjacent blades as are carried by said magazine; and said clamping and carrying means further comprises means for engaging said second limit stop element and changing its position from one of said first and second positionings thereof to the other thereof.

15. Blade stropping apparatus means, according to claim 14, wherein:

said position changing means comprises means for changing said second limit stop element position from said first to said second position thereof.

* * * * *